United States Patent [19]

Okuyama et al.

[11] Patent Number: 4,617,883

[45] Date of Patent: Oct. 21, 1986

[54] PIVOT MEMBERS FOR A CAM FOLLOWER OF VALVE MECHANISM FOR INTERNAL COMBUSTION ENGINE

[75] Inventors: Takahiro Okuyama, Tokyo; Susumu Toki, Kawagoe; Masahito Ishihara, Kani, all of Japan

[73] Assignees: Honda Giken Kogyo Kabushiki Kaisha, Toyko; Tokai TRW & Co., Ltd., Kasugai, both of Japan

[21] Appl. No.: 780,771

[22] Filed: Sep. 27, 1985

[30] Foreign Application Priority Data

Sep. 28, 1984 [JP] Japan ..... 59-203737

[51] Int. Cl.[4] ..... F01L 1/46

[52] U.S. Cl. ..... 123/90.44; 123/90.41; 123/90.39

[58] Field of Search ..... 123/90.44, 90.41, 90.43, 123/90.39

[56] References Cited

U.S. PATENT DOCUMENTS

| | | | |
|---|---|---|---|
| 3,166,058 | 1/1965 | Zink | 123/90.44 |
| 3,463,131 | 8/1969 | Dolby | 123/90.44 |
| 3,563,216 | 2/1971 | Uemura | 123/90.44 |
| 3,618,574 | 11/1971 | Miller | 123/90.44 |
| 3,791,355 | 2/1974 | Bergmann et al. | 123/90.44 |
| 4,346,678 | 8/1982 | Wherry | 123/90.44 |
| 4,359,019 | 11/1982 | Gaede | 123/90.46 |
| 4,369,740 | 1/1983 | Seidl | 123/90.45 |

FOREIGN PATENT DOCUMENTS

| | | | |
|---|---|---|---|
| 0013017 | 2/1978 | Japan | 123/90.44 |

*Primary Examiner*—Ira S. Lazarus

*Attorney, Agent, or Firm*—Armstrong, Nikaido, Marmelstein & Kubovcik

[57] ABSTRACT

The curved surface of the semi-spherical recess is defined such that a center of the curvature of the semi-spherical recess in a longitudinal section including a center line of the semi-spherical recess deviates from the center line, and a radius of curvature of the recess is greater than a radius of curvature of the spherical fitting portion.

4 Claims, 4 Drawing Figures

PIVOT MEMBERS FOR A CAM FOLLOWER OF VALVE MECHANISM FOR INTERNAL COMBUSTION ENGINE

BACKGROUND OF THE INVENTION

This invention relates to a valve mechanism for an internal combustion engine of the type in which a semi-spherical recess is formed on a pivot member disposed on an engine main body and a spherical fitting portion to fit to the semi-spherical recess is disposed at the base end of a cam follower that is interposed between a cam and an intake valve or an exhaust valve.

In a conventional valve mechanism of the kind described above, the center of curvature C1′ of the semi-spherical recess 10′ is disposed on its center line together with the center of curvature C2′ of the spherical fitting portion 12′. The radius of curvature R1′ of the semi-spherical recess 10′ is set to be greater than the radius of curvature R2′ of the spherical fitting portion 12′, as shown in FIG. 4 of the accompanying drawings.

In accordance with the conventional technique shown in FIG. 4, the spherical fitting portion 12′ and the semi-spherical recess 10′ come into contact with each other at the bottom of the semi-spherical recess 10′. Therefore, during the operation of the valve mechanism, lateral movement of the spherical fitting portion 12′ is repeated in accordance with the rocking of a cam follower and in an extreme case, the spherical fitting portion 12′ can override the rim of the semi-spherical recess 10′. Therefore, the contact position between the spherical fitting portion 12′ and the semi-spherical recess 10′ is unstable. Additionally, the noise of their contact is loud and irritating.

OBJECT AND SUMMARY OF THE INVENTION

To solve these problems, the present invention is directed to provide a valve mechanism which stabilizes the contact between the spherical fitting portion and the semi-spherical recess, and which reduces the noise of contact.

In accordance with the present invention, the curved surface of the semi-spherical recess is formed in such a fashion that the center of curvature in the longitudinal section including the center line of the semi-spherical recess deviates from the center line, and its radius of curvature is greater than that of the spherical fitting portion.

The contact point between the spherical fitting portion and the semi-spherical recess lies at an intermediate position of the inner surface of the semi-spherical recess, so that the quantity of any lateral movement of the spherical fitting portion can be reduced and the noise of contact can be reduced as much.

BRIEF DESCRIPTION OF THE DRAWINGS

The above and other objects and the attendant advantages of the present invention will become readily apparent by reference to the following detailed description when considered in conjunction with the accompanying drawings wherein:

FIGS. 1 through 3 show one embodiment of the present invention, wherein FIG. 1 is a longitudinal sectional view of the principal portions, FIG. 2 is an enlarged exploded and longitudinal sectional view useful for explaining the relation between the spherical fitting portion and the semi-spherical recess, and FIG. 3 is a schematic view showing the state in which the spherical fitting portion is fitted into the semi-spherical recess.

DETAILED DESCRIPTION OF A PREFERRED EMBODIMENT

Figure 1:
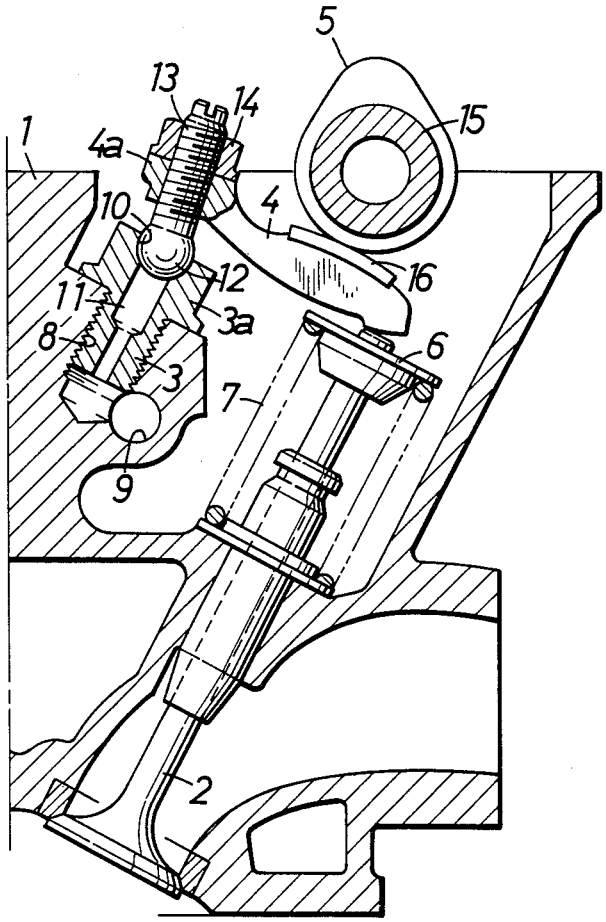

Hereinafter, one embodiment of the present invention will be described with reference to the accompanying drawings. In FIG. 1, a pivot bolt 3 as a pivot member is fitted to an engine main body 1 and pivotally supports the base end 4*a* of cam follower 4. The free end of the cam follower 4 comes into contact with the upper end of an intake valve 2 or an exhaust valve that is disposed in the engine main body 1. The engine valve 2 is opened and closed when the cam follower 4 is rocked by a cam 5.

A flange 6 is disposed at the upper portion of the valve 2. A coil-like valve spring 7 surrounding the valve 2 is interposed between the flange 6 and the engine main body 1. The valve spring 7 urges the intake valve 2 upward, that is, in the direction for closing the valve.

A screw hole 8 is bored at the upper portion of the engine main body 1 substantially in parallel with the opening and closing direction of the valve 2. A lubricant path 9 is defined in the engine main body 1 and communicates with the bottom of the screw hole 8. This lubricant path 9 is connected to a lubricant supply source (not shown).

The pivot bolt 3 is screwed into the screw hole 8 until its head 3*a* abuts the upper portion of the engine main body 1. The pivot bolt 3 is provided with a semi-spherical recess 10 at its upper end and with an oil hole 11 that opens at the center of the bottom of this semi-spherical recess 10 and extends in the axial direction. The lubricant is supplied from the lubricant supply source into the semi-spherical recess 10 through the lubricant path 9 and the oil hole 11.

An adjusting bolt 13 equipped at the tip with a spherical fitting portion 12 to fit to the semi-spherical recess 10 is movably screwed to the base end 4*a* of the cam follower 4. A lock nut 14 is fitted to the adjusting bolt 13 to fix its position.

A cam shaft 15, which is driven at a speed ratio of 1:2 in synchronism with the revolution of the crankshaft of the engine, is disposed above the cam follower 4. A slipper surface 16 is formed on the cam follower 4 in such a manner as to come into sliding contact with the cam 5 that is integrally formed on the cam shaft 15.

Figure 2:
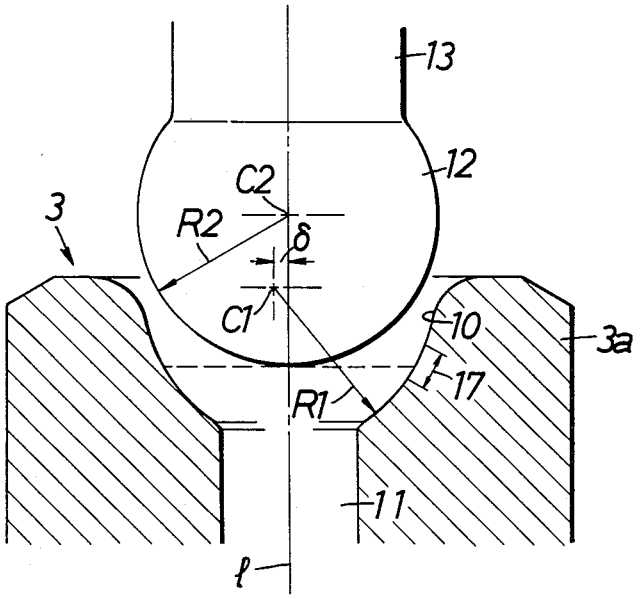

Referring to FIG. 2, the center of curvature C1 of the curved surface of the semi-spherical recess 10 of the pivot bolt 3 is positioned in such a manner that the center C1 deviates by $\delta$ from the center line l of the recess 10, that is, in the longitudinal sectional plane including the axis of the pivot bolt 3. The radius of curvature R1 is greater than the radius of curvature R2 of the spherical fitting portion 12. The center of curvature C2 of the spherical fitting portion 12 is positioned on the center line.

Figure 3:
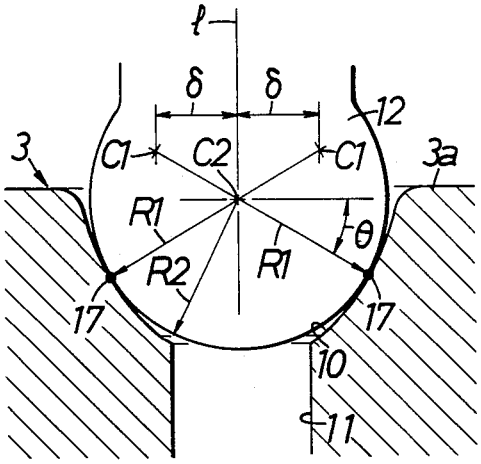
Figure 4:
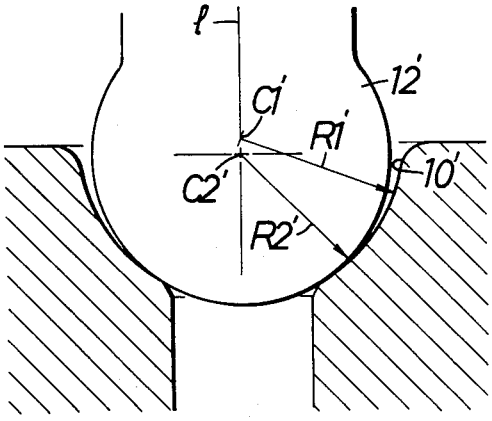
FIG.4 PRIOR ART
FIG. 4 is an explanatory view of a prior art apparatus which corresponds to the view shown in FIG. 3.

Referring to FIG. 3, the contact point 17 between the spherical fitting portion 12 and the semi-spherical recess 10 lies at an intermediate portion of the inner surface of the semi-spherical recess 10 when the spherical fitting portion 12 is fitted to the semi-spherical recess 10. Preferably, this contact point 17 lies substantially at the half of the depth of the semi-spherical recess 10. In other words, the radius of curvature R1 of the semi-spherical recess 10 is determined so that when the spherical fitting portion 12 is fitted into the semi spherical recess 10, the center angle $\theta$ between the plane passing through the center of curvature C2 of the spherical fitting portion 12 and crossing the center line l at right angles and a line connecting the contact point 17 with the center of curvature C2 is from 20° to 45°, ideally 30°.

Next the operation of this embodiment will be described. As the cam 5 rotates, the cam follower 4 rocks while causing the spherical fitting portion 12 to rock in the semi-spherical recess 10, thereby opening and closing the intake valve 2. While the spherical fitting portion 12 is rocking in the semi-spherical recess 10, their contact point 17 is positioned substantially at half of the depth of the semi-spherical recess 10, so that the movement of the center of curvature C2 of the spherical fitting portion 12 will be minimal; hence, the position of the contact point 17 can be stabilized and the noise of contact can be greatly reduced. In other words, the angle between the tangential line at the contact line 17 and the plane crossing the center line l at right angles will only range from about 45° to 70°, so that the movement of the cam follower 4 in a direction along the plane can be effectively prevented. Further, the load in the direction of the center line can be sufficiently borne at the contact point 17. For these reasons, the movement can be kept minimal and the position of the contact point 17 can be stabilized as described above.

As described above, in accordance with the present invention, the curved surface of the semi-spherical recess is formed in such a fashion that the center of curvature in the longitudinal section including the center line of the semi-spherical recess deviates from the center line, and the radius of curvature is greater than that of the spherical fitting portion. Therefore, the spherical fitting portion and the semi-spherical recess come into mutual contact at a contact point which is closer to the center of curvature of the spherical fitting portion than in the prior art apparatus. The amount of undesired movement of the center of curvature of the spherical fitting portion in both the horizontal and vertical directions can be reduced. In consequence, the contact position between the spherical fitting portion and the semi-spherical recess can be stabilized, and the noise of contact can be reduced.

It is readily apparent that the above-described pivot members for a cam follower of valve mechanism for internal combustion engine meet all of the objects mentioned above and also have the advantage of wide commercial utility. It should be understood that the specific form of the invention hereinabove described is intended to be representative only, as certain modifications within the scope of these teachings will be apparent to those skilled in the art. Particularly, it will be apparent that the spherical fitting portion can be mounted on the pivot bolt whereas the semi-spherical recess can be formed on the adjusting bolt screwed to the base end of the cam follower, conversely to the foregoing illustrated embodiment.

Accordingly, reference should be made to the following claims in determining the full scope of the invention.

What is claimed is:

1. In a valve mechanism for an internal combustion engine of the type in which a semi-spherical recess is formed on either one of a pivot member disposed on an engine main body and a base end of a cam follower interposed between a cam and a valve of the engine and a spherical fitting portion to fit to said semi-spherical recess is disposed at the other of said pivot member and the base end of said cam follower, the improvement wherein a curved surface of said semi-spherical recess is defined such that a center of curvature of said semi-spherical recess in a longitudinal section including a center line of said semi-spherical recess deviates from said center line, and a radius of curvature of said recess is greater than a radius of curvature of said spherical fitting portion.

2. The valve mechanism for an internal combustion engine as defined in claim 1 wherein the radius of curvature of said semi-spherical recess is determined such that a contact point of said spherical fitting portion with said semi-spherical recess is positioned substantially at half of the depth of said semi-spherical recess.

3. The valve mechanism for an internal combustion engine as defined in claim 1, wherein the radius of curvature of the semi-spherical recess is determined such that a center angle between a plane passing through a center of curvature of said spherical fitting portion and crossing said center line of said recess at right angles and a line connecting a contact point between said spherical fitting portion and said recess with said center of curvature of said spherical fitting portion is from 20° to 45°.

4. The valve mechanism for an internal combustion engine as defined in claim 3, wherein said center angle is approximately 30°.

* * * * *